US006758342B1

(12) United States Patent
Harada

(10) Patent No.: US 6,758,342 B1
(45) Date of Patent: Jul. 6, 2004

(54) CEREAL GRAIN SORTING SYSTEM AND ROLL SORTING MACHINE

(75) Inventor: Toshikazu Harada, Ageo (JP)

(73) Assignee: Harada Sangyo Co., Ltd., Saitama (JP)

( * ) Notice: Subject to any disclaimer, the term of this patent is extended or adjusted under 35 U.S.C. 154(b) by 0 days.

(21) Appl. No.: 09/980,253

(22) PCT Filed: Apr. 4, 2000

(86) PCT No.: PCT/JP00/02186

§ 371 (c)(1),
(2), (4) Date: Nov. 29, 2001

(87) PCT Pub. No.: WO01/74501

PCT Pub. Date: Oct. 11, 2001

(51) Int. Cl.[7] ..... B07C 5/34

(52) U.S. Cl. ..... 209/707; 209/691; 209/693; 209/12.1; 209/13

(58) Field of Search ..... 209/691, 692, 209/693, 707, 13, 19, 26, 21, 38, 40, 44

(56) References Cited

U.S. PATENT DOCUMENTS 3,888,352 A * 6/1975 Kulseth ..... 209/643
4,971,684 A * 11/1990 Mueller ..... 209/44
5,333,738 A * 8/1994 Fuchs et al. ..... 209/38
5,467,700 A * 11/1995 Dowell et al. ..... 99/570
5,669,511 A * 9/1997 Satake et al. ..... 209/580
5,733,592 A * 3/1998 Wettstein et al. ..... 426/416
5,860,531 A * 1/1999 Satoru et al. ..... 209/37

FOREIGN PATENT DOCUMENTS

| | | |
|---|---|---|
| JP | 1981-13072 | 2/1981 |
| JP | 1981-39164 | 4/1981 |
| JP | 1981-102681 | 8/1981 |
| JP | 06226441 | 8/1994 |
| JP | 10165895 | 6/1998 |

* cited by examiner

*Primary Examiner*—Donald P. Walsh
*Assistant Examiner*—Jonathan R. Miller
(74) *Attorney, Agent, or Firm*—Rader, Fishman & Grauer PLLC

(57) ABSTRACT

A cereal grain sorting system includes a wind force sorting device, a rough sorting device and a roll sorting device. The wind force sorting device is operative for selectively sorting light weight foreign materials from feedstock cereal grains. The rough sorting device is operative for selectively removing foreign materials having different diameters from the standard one from the feedstock cereal grains. The roll sorting device is operative for selectively removing foreign materials having different forms from the standard ones from the feedstock cereal grains having been subjected to the wind force sorting step as well as to the rough sorting step.

10 Claims, 12 Drawing Sheets

CEREAL GRAIN SORTING SYSTEM AND ROLL SORTING MACHINE

TECHNICAL FIELD

The present invention relates to a cereal grain sorting system capable of selectively and completely removing foreign materials such as coats, stem pieces, various seeds like mustard seeds and grass seeds, corn, dust, waste, stones, and metal pieces, or defective products such as worm-eaten beans, broken beans, and cracked beans from cereal grains such as soybeans or red beans, and to a roll sorting machine which can be incorporated in the cereal grain sorting system.

BACKGROUND ART

Conventionally there has been used a sorting system comprising a rough sorting machine, a specific gravity sorting machine, and a spiral sorting machine for selectively removing foreign materials such as coats, stem pieces, various seeds like mustard seeds and grass seeds, corn, dust, waste, stones, and metal pieces, or defective products such as worm-eaten beans, broken beans, and cracked beans from cereal grains such as soybeans or red beans.

In this sorting system, foreign materials having different grain diameters from a specified one are selectively removed by the rough sorting machine, those having different specific gravities from a standard one are selectively removed by the specific gravity sorting machine, and also those having different mass from a standard one are selectively removed with the spiral sorting machine by making use of the centrifugal speed, and thus foreign materials and defective products are removed from the feedstock cereal grains.

However, when the specific gravity sorting machine requiring a large volume of air is operated for a long time in a sorting plant where 5 to 20 tons of cereal grains not having been sorted yet in the very dusty atmosphere, clogging occurs in a cover for protecting the machine, or cracked beans drop to a section under the screen and are clogged between static airflow adjusting plates so that the sorting state always changes, and when the airflow becomes smaller, light weight foreign materials are mixed in acceptable products, which remarkably lowers the sorting precision, and therefore it is required for the operator to always monitor and adjust the machine or to clean the machine, and the work load is very heavy. In addition, the specific gravity sorting machine requires a large volume of air to be supplied, which not only makes a cloud of dust and worsens the working environment, but also causes heavy noises of 100 phons or more.

In the spiral sorting machine, cereal grains are dropped along a circular inclined surface and foreign materials having different mass from the cereal grains are selectively removed by making use of the centrifugal speed, but adjustment for a size and a shape (flatness) of the feedstock cereal grains is not possible at all, so that the sorting precision is rather low, and in addition, foreign materials such as corns, broken beans, and stone pieces are collided by acceptable products continuously flowing along the inclined surfaces and are pushed out to the acceptable product side to be mixed therein, and when the centrifugal speed drops due to the effect of dust or others in the atmosphere at the working site, the acceptable products may be mixed in foreign materials, which may in turn lowers the yield.

Further in the sorting system as described above, dust raised by the specific gravity sorting machine are deposited around acceptable products, so that the acceptable products become dusty, and in addition, as the spiral sorting machine is a internally sealed type of device, dust is easily deposited inside the machine, and the dust released from the specific gravity sorting machine may cause operation fault or other troubles of the spiral sorting machine, and therefore the operational stability in long time use is rather low.

As a roll sorting machine which can be incorporated in a cereal grain sorting system, there has been known one in which an endless belt is hung over a lower roll and an upper roll positioned in parallel to and diagonally above the lower roll and the upper roll is rotated so that a top surface of the belt moves to the upper roll. Also, there has been known another one in which the endless belt is oriented in the traveling direction or in a direction perpendicular to the traveling direction (Japanese Patent Publication No. SHO 31-1361).

The present applicant has conducted hard and strenuous research and development efforts in the field of roll sorting machine, and developed several novel sorting machines including one capable of completely separating not only foreign materials which have flat, angular, or irregular spherical forms and can not rotate, but also defective products such as cracked beans and worm-eaten beans which have similar spherical forms as regular spherical forms and can rotate from spherical bodies such as soybeans, red beans, and pearls each having a spherical form, in which the distance required for sorting may be short and can be built in a compact form because the twisted curved surface of the endless belt is utilized and also which can smoothly sort a large quantity of soybeans or the like (Japanese Patent Publication No. SHO 57-28307). Another one capable of accurately sorting not only foreign materials having flat or angular forms, but also those like cracked beans or worm-eaten beans which can rotate, enabling free and smooth adjustment for discharge percentages of sorted materials to an outlet for acceptable products and a second outlet for rejected products or foreign materials according to an open/close degree of a separation means, which can efficiently be formed into a multi-stage device with a short sorting distance and can be built in compact form, and also which can efficiently screen a large volume of feedstock soybeans because it can easily treat the feedstock soybeans piled up when fed with a saw-toothed plate (Japanese Patent Laid-Open Publication No. HEI 10-165895).

However, in the conventional type of roll sorting machine, 1) as a supply rate of cereal grains from the feedstock cereal grains is not stable, sometimes cereal grains as overflow from the inlet of the feedstock cereal grains may clog, and when a quantity of cereal grains surpassing the processing capacity of the machine is supplied even temporally, the sorting precision may become remarkably lower. 2) Cereal grains such as soybeans have an oval form, and in the case of cereal grains having an oval form, when a moving speed of a belt reaches a prespecified speed, each piece of the cereal grains rises up and starts rotating, which makes roll sorting possible, but a belt speed optimum for starting rotation varies according to forms of the cereal grains, and therefore the sorting precision varies according to types of the cereal grains. 3) In case of a multiple stage roll sorting machine in which a plurality of roll sorting machines are piled up in the multiple stages, sprocket wheels of upper rolls of respective stages are linked to each other with a chain, and the belts in the multiple stages are moved simultaneously with one driving force source. Because of this configuration, when a number of stages is large, the chain becomes longer and troubles easily occur. Further, when oil is supplied for maintenance of the chain, sometimes the oil may spatter to contaminate the feedstock cereal grains, and if the chain is left uncovered after the maintenance, it is very dangerous, which is disadvantageous for the safety of operators.

DISCLOSURE OF THE INVENTION

The present invention was made to solve the problems described above, and it is an object of the present invention to provide a cereal grain sorting system which allows stable operations for a long time without requiring supply of a large quantity of air, and which can provide high quality final products relatively quietly and keeping the sorting precision and high production yield without further worsening the working conditions.

The present invention was made also to solve the problems of the roll sorting machine described above, and it is an object of the present invention to provide a roll sorting machine which can insure safety for workers and also can prevent the sorting precision from varying due to differences of forms of cereal grains without causing the fed feedstock cereal grains to overflow from or clog the inlet of the sorting machine, without lowering the sorting machine caused by supply of a large quantity of cereal grains surpassing a regular throughput of the sorting machine, and further without causing contamination of the cereal grains.

DISCLOSURE OF THE INVENTION

To solve the problems in the cereal grain sorting system as described above, the cereal grain sorting system according to the present invention comprises a wind force sorting process of selectively removing light weight foreign materials from feedstock cereal grains, a rough sorting process of selectively removing foreign materials having different diameters from the feedstock cereal grains, and a roll sorting process of selectively removing foreign materials having different forms from the feedstock cereal grains having been subjected to the wind force sorting process and the rough sorting process.

In the cereal grain sorting system according to the present invention, when magnetic foreign materials such as metal pieces are mixed in the feedstock cereal grains, the magnetic foreign materials can selectively and efficiently be removed by providing a magnetic force sorting process, and this configuration is a preferable mode.

Further in the cereal grains sorting system according to the present invention, when stone pieces are mixed in the feedstock cereal grains, the stone pieces can efficiently be removed by further providing a stone-piece removal process of selectively removing the stone pieces from the feedstock cereal grains, which is preferable.

In the cereal grain sorting system according to the present invention, when fine materials such as dust and mud are deposited on the feedstock cereal grains, by further providing a polishing process of removing the fine deposited materials from the feedstock cereal grains by polishing, the fine deposited materials such as dust and mud can efficiently be removed, which is more preferable.

In the cereal grain sorting system according to the present invention, when it is necessary to sort the final products according to grain diameters, by further providing a grain diameter sorting process of sorting the feedstock cereal grains according to the grain diameters, it is possible to sort the final products according to the gain diameters, which makes it possible to advantageously supply the final products sorted according to the grain diameters to satisfy the consumers' demands.

To solve the problems in the roll sorting machine described above, in the roll sorting machine according to the present invention, an endless belt is hung over a lower belt and an upper roll positioned diagonally above the lower roll, the lower roll and upper roll are inclined in the same direction at prespecified angles respectively with the inclination angle of the lower roll smaller than that of the upper roll. Further one or more saw-toothed plates are provided on a top surface of the endless belt, and, at the same time, a lengthy inclined discharge plate inclining downward in the sideward direction is provided at a side edge in the downwardly inclining side of the endless belt. This roll sorting machine according to the present invention is characterized in that a constant rate supply unit for supplying feedstock cereal grains at a specified constant rate to a feedstock cereal grain inlet is provided so that feedstock cereal grain supply rate can freely be adjusted.

Further, in the roll sorting machine according to the present invention, an endless belt is hung over a lower roll and an upper roll positioned diagonally above the lower roll, the lower roll and upper roll are inclined in the same direction at prespecified angles respectively with the inclination angle of the lower roll smaller than that of the upper roll. Further, one or more saw-toothed plates are provided on a top surface of the endless belt, and, at the same time, a lengthy inclined discharge plate inclining downward in the sideward direction is provided at a side edge in the downwardly inclining side of the endless belt. This sorting machine is characterized in that a speed-variable driving force source for changing a driving speed of the endless belt is provided and the driving speed for the endless belt can freely be changed or adjusted according to forms of fed feedstock cereal grains so that the feedstock cereal grains rotate and drop.

Still further, in the roll sorting machine according to the present invention, an endless belt is hung over a lower roll and an upper roll positioned diagonally above the lower roll, the lower roll and upper roll are inclined in the same direction at prespecified angles respectively with the inclination angle of the lower roll smaller than that of the upper roll. Further, one or more saw-toothed plates are provided on a top surface of the endless belt, and, at the same time, a lengthy inclined discharge plate inclining downward in the sideward direction is provided at a side edge in the downwardly inclining side of the endless belt. This roll sorting machine is characterized in that a constant rate supply unit for supplying feedstock cereal grains at a prespecified rate to a feedstock cereal grain inlet, and a supply rate of the feedstock cereal grains can freely be adjusted. Further, a speed-variable driving force source for changing a driving speed for the endless belt is provided and the driving speed for the endless belt can freely be changed or adjusted according to forms of fed feedstock cereal grains so that the feedstock cereal grains rotate and drop.

In the roll sorting machine, when the constant rate supply unit is a vibration type of constant rate supply unit for supplying the feedstock cereal grains at a specified constant rate with vibration, a more stable and a more uniformed constant supply of feedstock cereal grains can advantageously be performed.

In the roll sorting machine, when the speed-variable driving force source is a direct linkage type of speed-variable driving force source directly connected to an edge of this upper roll, use of a chain is not required, so that the problems such as chain troubles, contamination of the feedstock cereal grains, and those concerning the safety for operators are advantageously eliminated.

In the roll sorting machine, by monitoring the cereal grains fed onto an upper surface of the endless belt by a monitor camera as to whether the cereal grains are rotating in the acceptable state and adjusting a driving speed for the endless belt so that the cereal grains rotate and drop, it is to perform optimum roll sorting suited for forms of various types of cereal grains. Further, it is possible to maintain the sorting precision even if various types of cereal grains are fed, which is more preferable.

Further in the roll sorting machine, by monitoring the cereal grains fed onto an upper surface of the endless belt by a monitor camera as to whether the cereal grains are rotating in the acceptable state and adjusting inclination angles of the upper roll and lower roll as well as an angle between a central axis of the upper roll and that of the lower roll respectively, it is possible to insure optimal conditions for roll sorting, which is advantageous.

Further, when the roll sorting machine is embodied as a multiple stage roll sorting machine formed by stacking the roll sorting machines in multiple stages in which a speed-variable driving force source is provided for an upper roll in each stage respectively so that a driving force for the endless belt for each stage can freely be adjusted and changed, an optimum rotating speed for the cereal grains supplied thereto can be realized for each stage, and because of this configuration, the roll sorting machine can treat various types of cereal grains more flexibly.

Further when the roll sorting machine is embodied as a multiple stage roll sorting machine in which a constant rate supply unit for supplying cereal grains to feedstock cereal grain inlet for each stage so that a supply rate of the feedstock cereal grains can freely be adjusted, it is possible to supply the feedstock cereal grains to each stage under stable and uniform conditions, which is more preferable.

Further, when a roll sorting process is carried out with the roll sorting machine in a cereal grain sorting system, the cereal grain sorting system becomes more advantageous in terms of its sorting precision, operational stability, and safety during operations.

BEST MODE FOR CARRYING OUT THE INVENTION

Embodiments of the cereal grain sorting system according to the present invention are described below. It is to be noted that the embodiments are described herein for illustrative purpose, and that this invention is not limited to the embodiments.

Figure 1:
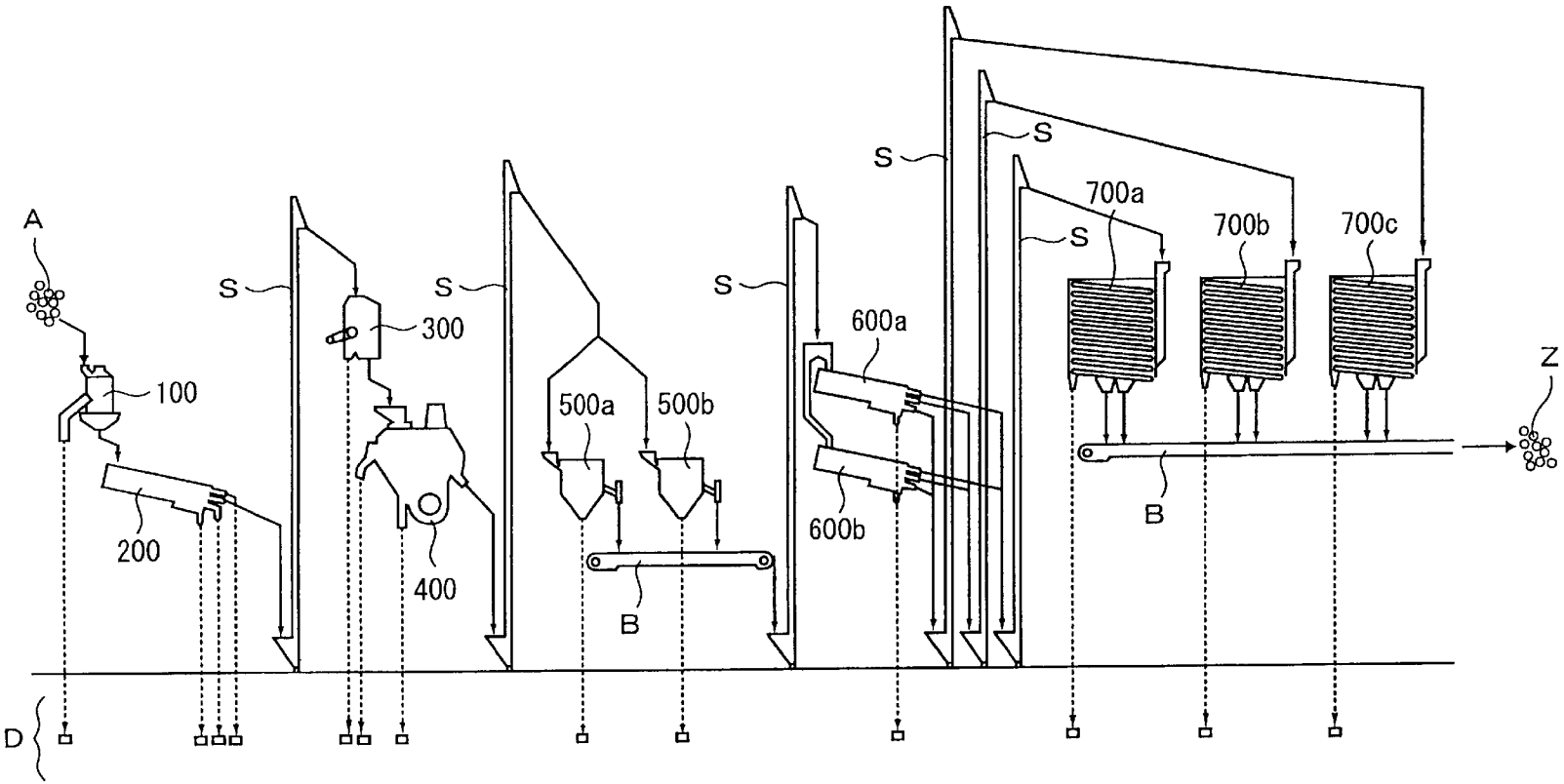
FIG. 1 is a general explanatory view showing a flow of a cereal grain sorting system according to the present invention viewed from its side.

In FIG. 1, the reference letter A indicates feedstock cereal grains as an object for processing by the cereal grain sorting system according to the present invention, the reference letter D indicates the foreign materials sorted and removed in each of the steps described above, the reference letter S indicates a lift transferring the cereal grains up and down between the processing processes, the reference letter B indicates a belt conveyor for transporting the feedstock cereal grains A, and the reference letter Z indicates the sorted final products.

The reference numeral 100 indicates a sucking type of wind force sorting machine for carrying out the wind force sorting process for selectively removing light weight foreign materials from the cereal grains. This sucking type of wind force sorting machine 100 selectively removes light weight foreign materials (dust, coats, and other small refuse) with a sucking wind force. Any known type of wind force sorting machine may be used for this wind force sorting machine.

The reference numeral 200 indicates a rough sorting machine for roughly sorting foreign materials having been subjected to the sorting process for selectively removing light weight foreign materials from the feedstock cereal grains A in the wind force sorting process described above and yet having diameters from a standard one respectively. This rough sorting machine 200 selectively removes foreign materials having a larger diameter from the standard one (such ascorn, mud blocks, and stone pieces) and those having a smaller diameter from the standard one (such as seeds, glass seeds, and small stone pieces) by means of sieving performed by vibrating a punching plate for remaining foreign materials having a larger diameter from the standard one thereon and also for dropping those having a smaller diameter from the standard one therefrom. Any known type of rough sorting machine (grain diameter sorting machine) may be used for this rough sorting machine.

The rough sorting process may be carried out before the wind force sorting process.

The reference numeral 300 indicates a drum-shaped magnetic sorting machine for selectively removing magnetic foreign materials from the cereal grains A having been subjected to the rough sorting process described above for selectively sorting foreign materials having a different diameter from the standard one. This drum-shaped magnetic sorting machine 300 selectively removes magnetic foreign materials such as metallic substances by making use of an attracting effect of a magnet provided inside a rotary drum. Any known type of drum-shaped magnetic sorting machine may be used for the drum-shaped magnetic sorting machine.

The magnetic sorting process with this drum-shaped magnetic sorting machine 300 may be provided only when magnetic foreign materials such as metal pieces are mixed in the feedstock cereal grains A, and when it is clear that any magnetic foreign material is not mixed in the cereal grains, the process is not necessary, and in addition this magnetic sorting process may be performed between any process in the cereal grain sorting system according to the present invention.

The reference numeral 400 indicates a stone-piece removing machine used in the stone-piece removal process for selectively removing stone pieces from the cereal grains A having been subjected to the magnetic sorting process as described above for selectively removing magnetic foreign materials. This stone-piece removing machine 400 selectively removes stone pieces by sending air from under a porous sorting plate inclined to a direction and vibrating the porous sorting plate to move only heavy stone pieces to the inclined upper side of the inclined screen. Any known type of stone-piece removing machine may be used for the stone-piece removing machine.

The stone-piece removal process with this stone-piece removing machine 400 may be provided only when it is clear that stone pieces are mixed in the feedstock cereal grains A, and this process may be eliminated when it is clear that stone pieces are not mixed in the feedstock cereal grains A, and further this process may be carried out between any processes in the cereal grain sorting system according to the present invention.

The reference numerals 500*a* and 500*b* each indicate a polishing machine used in a polishing process for polishing off and removing fine deposits (such as dust, mud and the like) from the cereal grains A having been subjected to the stone-piece removal process for selectively removing stone pieces. In the polishing machine 500*a*, 500*b*, a plurality of polishing belts are provided in a radial form along an internal peripheral surface of a fixed cylindrical net-formed screen, and fine deposits are polished off and removed by rotating and moving the polishing belt along the net-formed screen and passing the feedstock cereal grains A between the net-formed screen and the polishing belt. Any known type of polishing machine may be used for this polishing machine.

This polishing process with the polishing machine 500*a*, 500*b* may be provided only when fine deposits are present on the feedstock cereal grains A, and when it is clear that fine deposits are not on the feedstock cereal grains A, this process may be omitted. Further this process may be carried out between any processes in the cereal grain sorting system according to the present invention.

The reference numerals 600*a*, 600*b* each indicate a grain diameter sorting machine for sorting the cereal grains A having been subjected to the polishing process described above for polishing off and removing fine deposits on the cereal grains A according to a diameter of each grain (large diameter grains, medium diameter grains, and small diameter grains). The grain diameter sorting machine 600*a*, 600*b* sorts the feedstock cereal grains A according to the diameters by vibrating the punching plate for leaving foreign materials having a larger diameter from the standard one and dropping those having a smaller diameter from the standard one to under the punching plate. Any known type of grain diameter sorting machine may be used for this grain diameter sorting machine.

The grain diameter sorting process with the grain diameter sorting machine 600*a*, 600*b* may be omitted when it is not required to sort the final products according to their grain diameters, and may be carried out between any two steps in the cereal grain sorting system according to the present invention. Preferably this grain diameter sorting process should be carried out immediately before or after the roll sorting process.

The reference numerals 700*a*, 700*b*, 700*c* each indicates a roll sorting machine for selectively removing foreign materials having forms different from that of the cereal grains A having been subjected to the grain diameter sorting process for sorting the cereal grains A according to grain diameters (those having flat forms, angular forms, or irregularly round forms which can not rotate smoothly). In this roll sorting machines 700*a*, 700*b*, and 700*c*, an endless belt is hung over a lower roll and an upper roll arranged diagonally above the lower roll, the lower and upper rolls are inclined in one direction at a prespecified angle respectively with the inclination angle of the lower roll smaller than that of the upper roll, further one or more saw-toothed plates are provided on a top surface of the endless belt, a lengthy inclined discharge plate inclining downward is provided diagonally under the downwardly inclining side of the endless belt. When the endless belt is rotated in the direction to the upper roll, the rotatable round materials (acceptable products) rotates and drop downward, while the non-rotatable foreign materials do not rotate and are carried in the direction to the upper roll, where foreign materials having different forms are selectively removed. Any known roll sorting machine may be used for the roll sorting machine, but the roll sorting machine according to the present invention is more advantageous for instance in terms of sorting precision, operating stability, and safety during operation thereof.

Further in each of the machines used in each process described above, further a dust collector may be provided, and when the dust collector is additionally provided in each of the machines described above, fine dust and other foreign materials can be removed with a quality of acceptable products further improved, and also the atmosphere at the working site is further cleaned.

As described above, with the cereal grain sorting system according to the present invention, a specific gravity sorting machine requiring a large quantity of air to be supplied is not necessary, and stable operations can be performed for a long time without deteriorating the atmosphere at the working site, and further it is possible to obtain high quality final products relatively quietly maintaining the sorting precision and production yield.

Examples of the machines which can advantageously be used in the cereal grain sorting system according to the present invention are described below.

Figure 2:
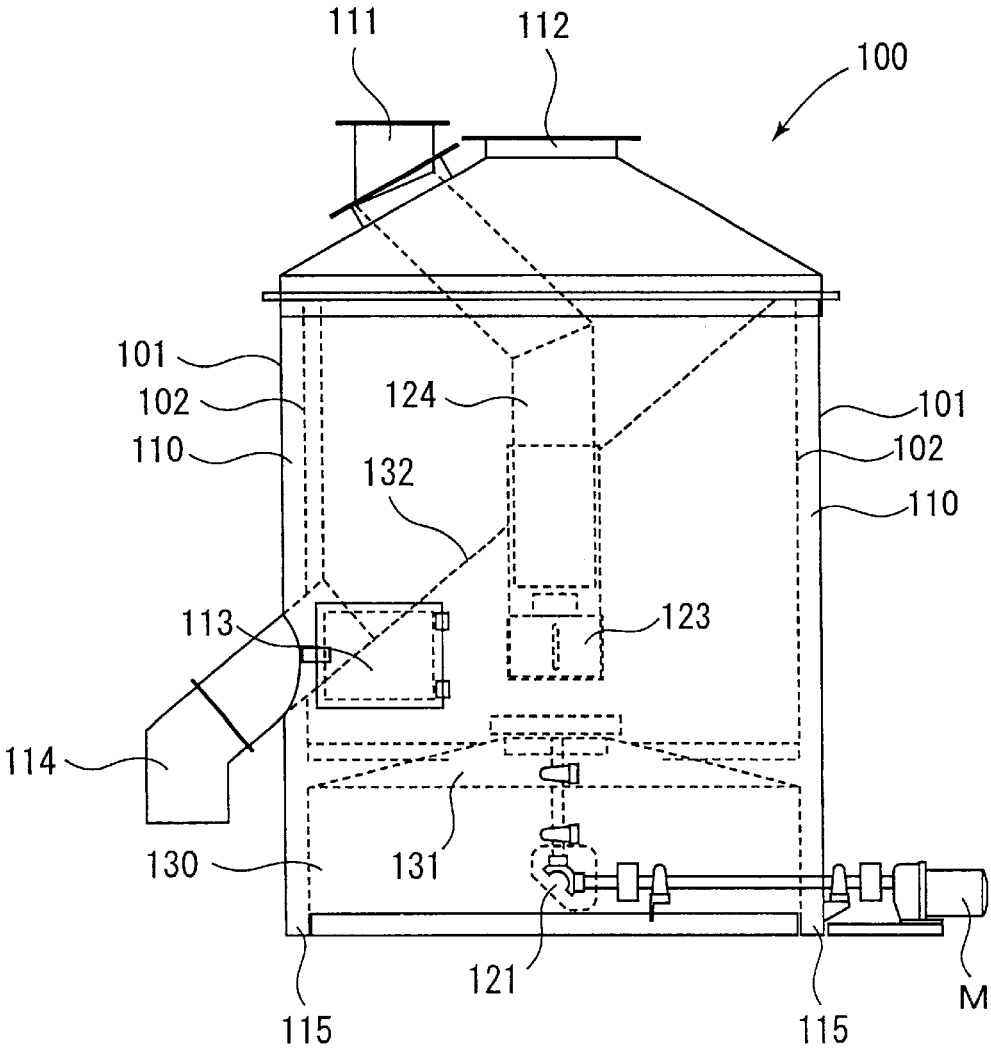
FIG. 2 is an explanatory view showing a sucking type of wind force sorting machine used in the cereal grain sorting system according to the present invention viewed from its front side.

In FIG. 2, the reference numeral 100 indicates a sucking type of wind force sorting machine (so called gravity separator). The sucking type of wind force sorting machine 100 is based on a double structure consisting of a cylindrical external frame body 101 and an internal frame body 102, and a ventilation section 110 through which air is sent from down to up is provided between the external frame body 101 and internal frame body 102. A dust collection port 112 is provided at an upper edge section of the sucking type of wind force sorting machine 100, and the dust is sucked by the dust collector. An inspection port 113 is provided on a side face of the external frame body 101 for convenience in maintenance work.

In the wind force sorting machine 100 described above, when feedstock cereal grains are fed from a feedstock inlet 111 provided in an upper section of the sucking type of wind force sorting machine 100, the feedstock passes through an feedstock inlet pipe 124 having a flow rate adjustment shutter 123 provided at its lower end, and is delivered onto a rotary plate 122 rotated and driven by a motor M via a bevel gear 121. The delivered feedstock cereal grains are dispersed in radial directions by the rotary plate 122, slip down along a surface of a conical section 131 in an upper section of the internal cylindrical body 130 and try to drop through the ventilation section 110, but as air is blown from the bottom to top through the ventilation section 110, so that light weight foreign materials such as dust, coats, glass seeds, and small refuse are sucked upward and collected through a dust collection port 112, or are collected in a dust receiving body 132 and discharged from a dust exit 114 to the outside, while the acceptable products having a different specific weight drop through the ventilation section 110 as they are and are discharged from an acceptable product outlet 115. The feedstock cereal grains are divided to acceptable products and light weight foreign materials to be disposed.

Figure 3:
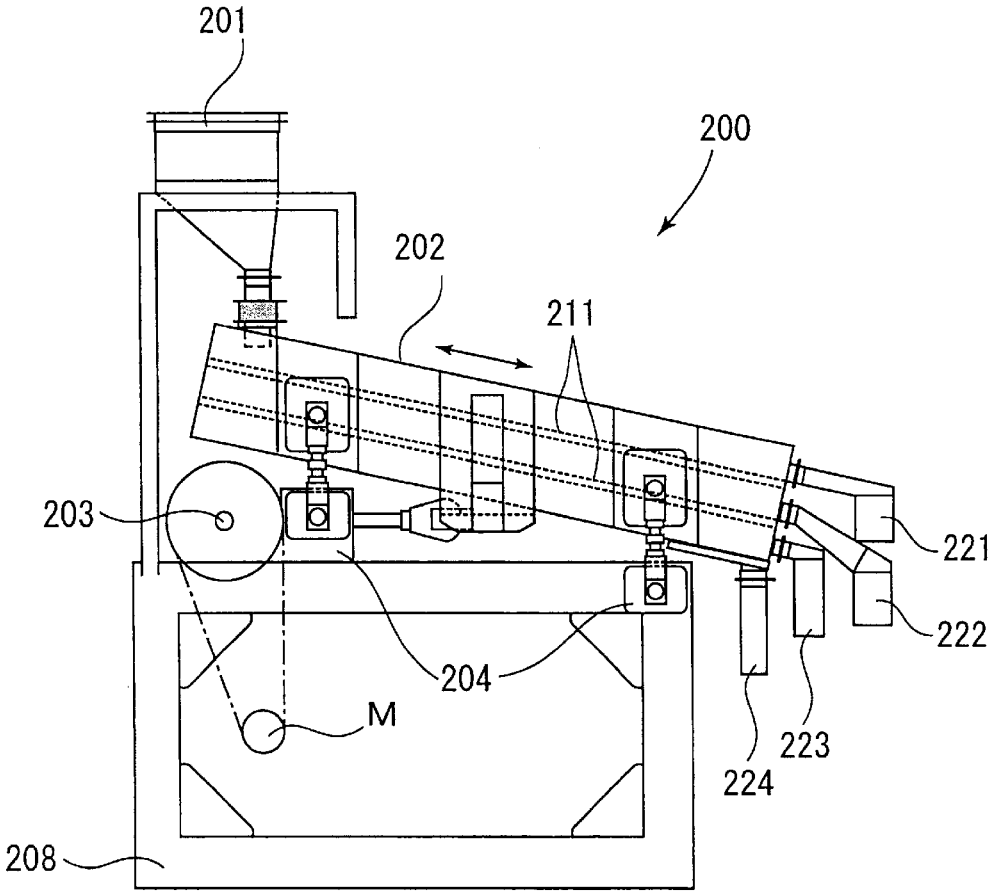
FIG. 3 is an explanatory view showing a rough sorting machine used in the cereal grain sorting system according to the present invention.

In FIG. 3, the reference numeral 200 indicates a rough sorting machine. The rough sorting machine 200 is supported with a support tool 204 on a base 208, and comprises a feedstock hopper 201, a crankshaft 203, a handle body 205*c* joined to the crankshaft 203, a motor M for rotating and driving the crankshaft 203, a large grain diameter material chute 221, an intermediate grain diameter chute 222, a small grain diameter chute 223, and a fine grain diameter material chute 224. Punching plates 211 for various classes of grain diameters are provided inside a casing 202. When the crankshaft 203 is rotated and driven by the motor M, the casing 202 is vibrated back and forth.

In the rough sorting machine 200, when feedstock cereal grains are fed from the feedstock hopper 201 and is transferred onto the punching plates 211 inside the casing 202, the feedstock cereal grains are sieved due to vibration and also to roughness of meshes of the punching plate according to the grain diameters, and foreign materials having a large diameter such as corn, stems, and large stone pieces are discharged from the large grain diameter material chute 221, foreign materials having a small diameter such as cracked beans, glass seeds, and small stone pieces are discharged from the small grain diameter chute 223, foreign materials having a fine diameter such as dust or the like are discharged from the fine grain diameter chute 224, and acceptable products are discharged from the medium grain diameter chute 222. Thus the feedstock cereal grains are separated to acceptable products and foreign materials having different diameters from the standard diameter of the acceptable products.

Figure 4:
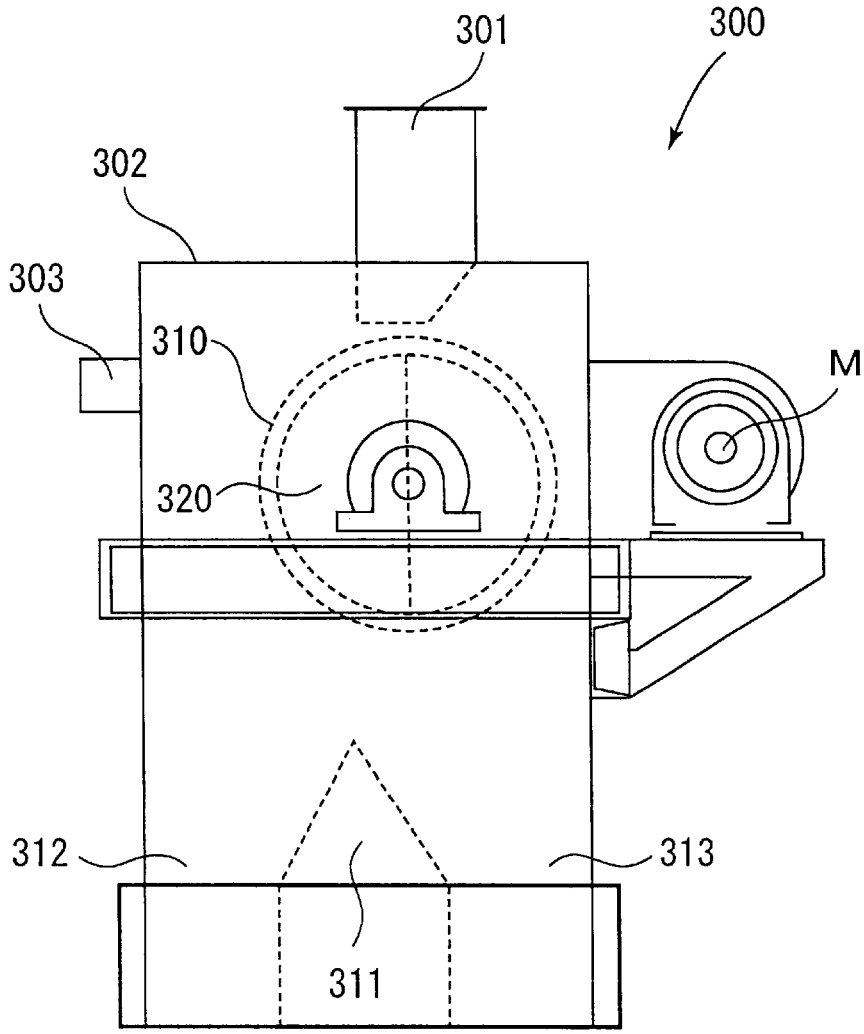
FIG. 4 is an explanatory view showing a side view of a drum-shaped magnetic sorting machine used in the cereal grain sorting system according to the present invention.

In FIG. 4, the reference numeral 300 indicates a drum-shaped magnetic sorting machine. The drum-shaped magnetic sorting machine 300 comprises a feedstock hopper 301, a dust collection pipe 302, and a motor M with a drum 310 and a partition member 311 provided inside a casing 302, and the a non-magnetic material outlet 312 is separated by the partition member 311 from a magnetic material output 313.

In the drum-shaped magnetic sorting machine 300, when the feedstock cereal grains are fed from the feedstock hopper 301 and are supplied onto the drum rotated and driven by the motor M, magnetic foreign materials such as metal pieces are attracted to a surface of the drum 310 because of the effects of a semi-circular magnet 320 provided inside the drum 310, transported to a lower edge of the semi-circular magnet and are discharged from a magnetic material outlet 313, while, as the acceptable products are non-magnetic, they are not attracted to a surface of the drum 310, drop as they are, and are discharged from the non-magnetic outlet 312. Thus the feedstock cereal grains are divided to acceptable products and magnetic foreign materials.

Figure 5:
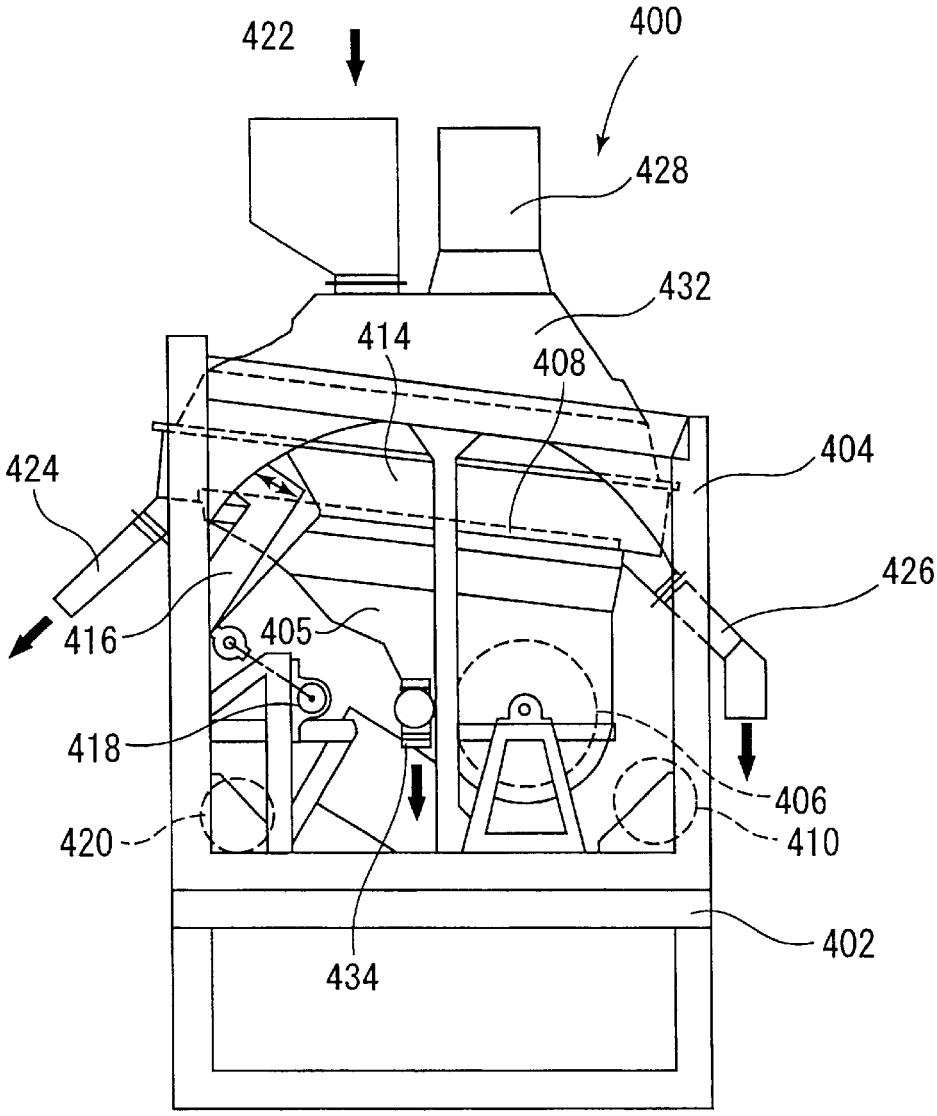
FIG. 5 is an explanatory view showing a side view of a stone-piece screening machine used in the cereal grain sorting system according to the present invention.

In FIG. 5, the reference numeral 400 indicates a stone-piece removing machine. The stone-piece removing machine 400 has a porous sorting plate 408 accommodated in a vibration box 414, and as shown in the figure, the porous sorting plate 408 is inclined at an appropriate angle. This inclination angle may be adjusted according to the necessity. The reference numeral 432 indicates a hood, and a feedstock hopper 422 is provided in the hood 432. The reference numeral 405 indicates an air channel provided in a lower section of the vibration box 414, and a blower fan unit 406 is accommodated in the air channel 405. It should be noted that the reference numeral 410 indicates a motor for driving the fan unit 406 and the reference numeral 434 indicates a dust outlet port communication to the fan unit 406.

The reference numeral 418 is an eccentric crank, which is driven by the motor 420. The eccentric crank 418 is connected to a lever 416 joined to the vibration box 414. When a rotating movement of the eccentric crank 418 is delivered as a reciprocal movement to the vibration box 414, the vibration box 414 and the porous sorting plate 408 provided in the vibration box 414 vibrate (oscillate) around an upper section of the arm.

The reference numeral 424 indicates a discharge port formed at an upper edge section of the porous sorting plate 408 for stone pieces with a large specific weight, while the reference numeral 426 indicates a discharge port formed at a lower edge of the porous sorting plate 58 for acceptable products with a relatively small specific weight.

In the stone-piece removing machine 400, the feedstock cereal grains are supplied to a central portion of the porous sorting plate 408, and air is blown upward from under the porous sorting plate 408 to flow the feedstock cereal grains. Because of this flow, acceptable products with a smaller specific weight than that of stone pieces come to the upper side from the stone pieces having a larger specific weight. The heavier materials in the lower side move diagonally upward in association with vibration of the porous sorting plate 408. The acceptable products in the upper side are little affected by the vibration effect, and move diagonally downward as the porous sorting plate 408 is inclined. The air is discharged from the dust collector pipe 428. As described above, the feedstock cereal grains are separated to acceptable products and stone pieces.

Figure 6:
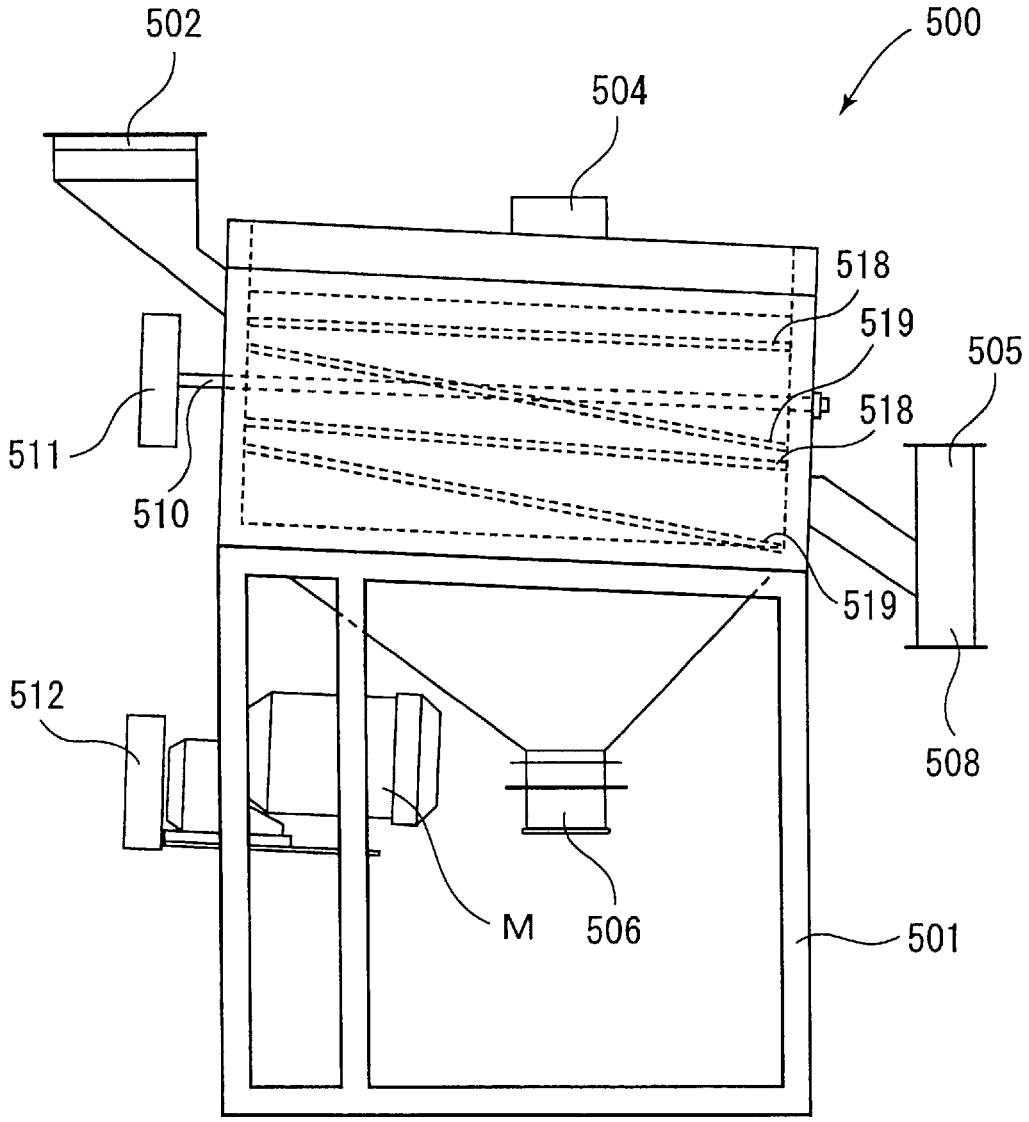
FIG. 6 is an explanatory view showing a polishing machine used in the cereal grain sorting system according to the present invention.

In FIG. 6, the reference numeral 500 indicates a polishing machine. The polishing machine 500 has a parallel polishing belt 518 and an inclined polishing belt 519 alternately provided along an internal peripheral surface of the cylindrical net-formed screen (not shown) in the radial form, and when the rotating shaft 510 is rotated, the parallel polishing belt 518 and inclined polishing belt 519 rotate along the internal peripheral surface of the cylindrical net-formed screen. The rotating shaft 510 is rotated by a belt hung over a rotating disk 512 which is rotated and driven by the motor M and a rotating disk 511 for rotating the rotating shaft 510. In this figure, further designated at the reference numeral

504 is a dust collection port, at 505 a dust collector pipe, at 506 a dust outlet, and at 501 a base.

In the polishing machine 500, when the feedstock cereal grains are fed from the feedstock hopper 502 and is supplied to the cylindrical net-formed screen, the feedstock cereal grains are polished by the parallel polishing belt 518 and inclined polishing belt 519 rotated and driven by the motor M with fine deposits removed therefrom, and the feedstock cereal grains are transferred by the feed effect by the inclined polishing belt 519 and are discharged from the acceptable product outlet 508. Thus the feedstock cereal grains are separated to acceptable products and fine deposits.

Figure 7:
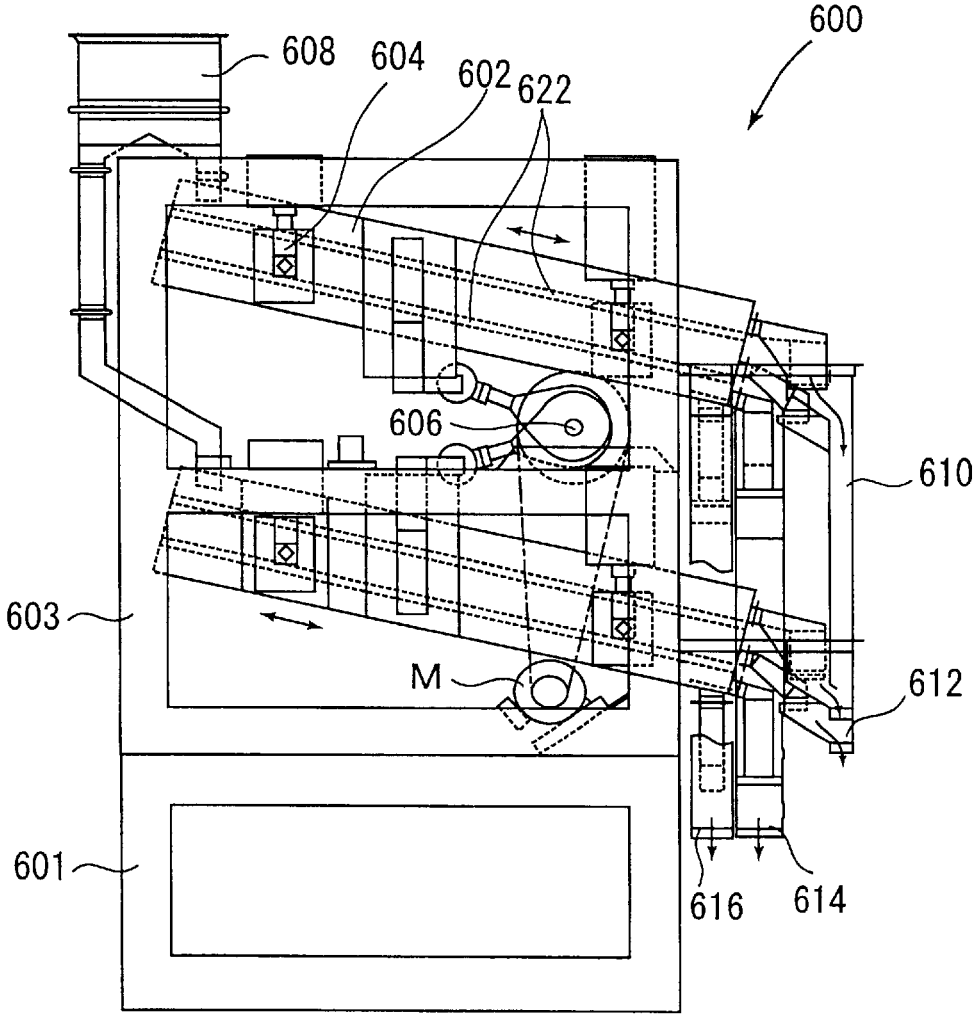
FIG. 7 is an explanatory view showing a grain-diameter sorting machine used in the cereal grain sorting system according to the present invention.

In FIG. 7, the reference numeral 600 indicates a grain diameter sorting machine. The grain diameter sorting machine 600 is a two-stage unit. In this figure, designated at the reference numeral 608 is a feedstock hopper, at 604 a hunger, at 606 a crankshaft, and at M a motor. Further in this figure, designated at the reference numeral 610 is a large grain diameter material collection chute, at 612 a medium diameter material collection chute, at 614 a small grain diameter material collection chute, and at 616 a fine grain diameter material collection chute. Punching plates 622 for various grain diameter classes are provided inside the casing 602. The casing 602 is mounted via a hunger 604 to a frame 603, and when the crankshaft 606 is rotated by the motor M, the casing 602 is vibrated back and forth.

In the grain diameter sorting machine 600, when the feedstock cereal grains are fed from the feedstock hopper 608 and are supplied onto the punching plates 622 inside the casing 602, the feedstock cereal grains are sieved according to the grain size classes because of vibration and due to differences in mesh roughness of the punching plates 622, and the large grain diameter materials are discharged from the large grain diameter material collection chute 610, the medium grain diameter materials are discharged from the medium grain diameter material collection chute 612, the small grain diameter materials are discharged from the small grain diameter material collection chute 614, and the fine grain diameter materials are discharged from the fine grain diameter material collection chute 616. The fine grain diameter materials are treated not as acceptable products, but as fine foreign materials. Thus the feedstock cereal grains are separated to large grain diameter materials, medium grain diameter materials, small grain diameter materials, and fine grain diameter materials.

An embodiment of the roll sorting machine according to the present invention which can be incorporated in the feedstock cereal grain sorting system according to the present invention is described below, but it is to be noted that the embodiment is provided for the illustrative purpose and that this invention is not limited to this embodiment. For convenience in descriptions, description of the embodiment assumes a case where feedstock soybeans with foreign materials and defective products mixed therein are sorted.

Figure 8:
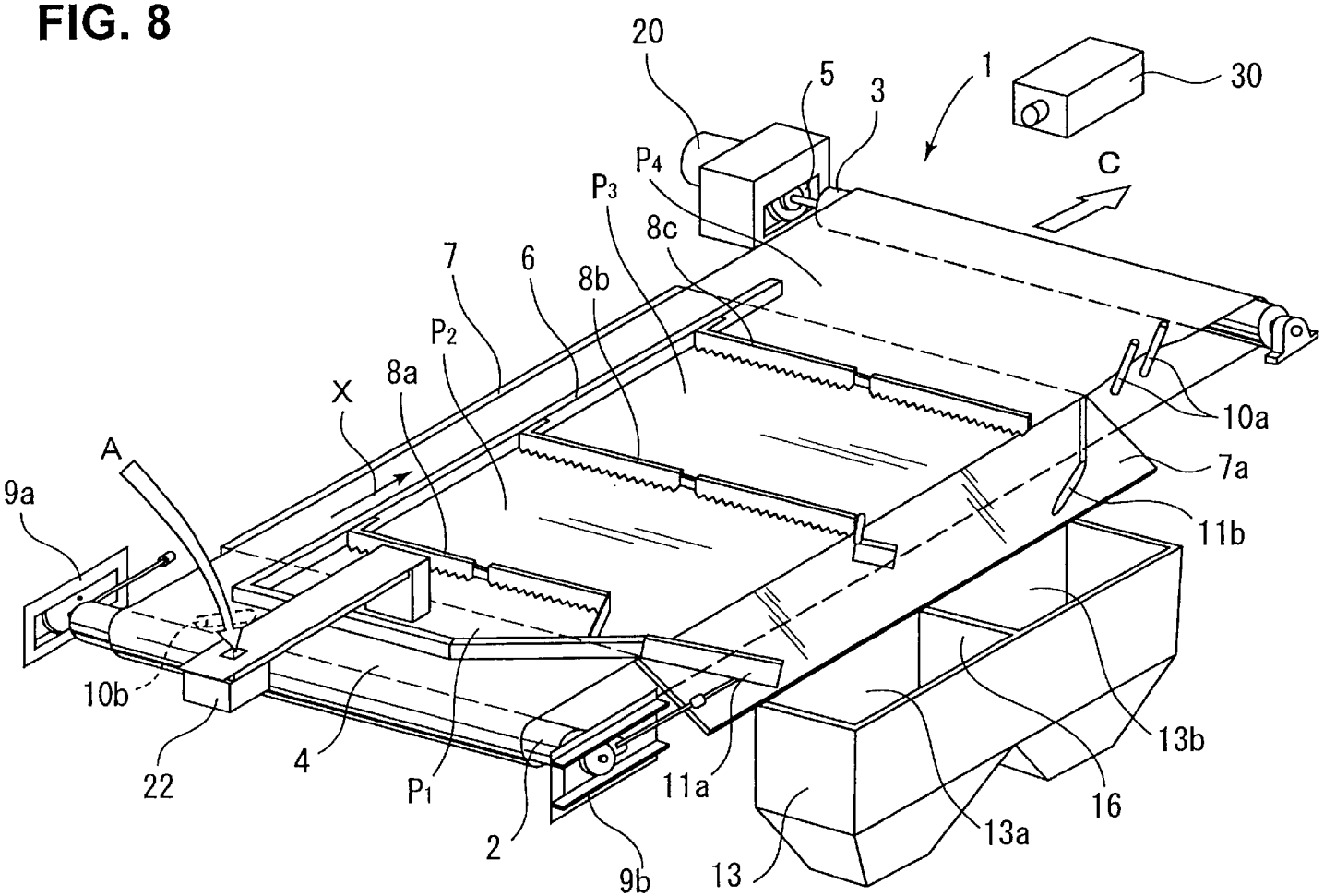
FIG. 8 is a perspective view showing one embodiment of a roll sorting machine according to the present invention.

FIG. 8 is a perspective view showing one embodiment of the roll sorting machine according to the present invention, and in this figure the reference numeral 1 indicates the roll sorting machine according to the present invention. The roll sorting machine 1 has an endless belt 4 hung over a lower roll 2 and an upper roll 3 provided diagonally above the lower roll 2.

Figure 9:
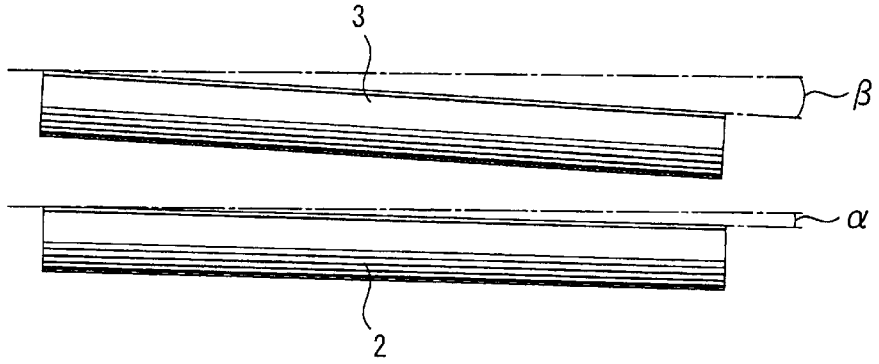
FIG. 9 is an explanatory view showing the arrangement of a lower roll as well as of an upper roll in the roll sorting machine according to the present invention viewed from the front side.

The lower roll 2 and upper roll 3 are provided with the same edge sections (right-hand edge sections in FIG. 9) downwardly inclining at prespecified angles of $\alpha$ and $\beta$ respectively as shown in FIG. 9. As for the inclination angles of $\alpha$ and $\beta$ of lower and upper rolls, the inclination angle $\alpha$ should preferably be smaller than the inclination $\beta$ to insure the good sorting effect. The inclination $\alpha$ should preferably be in the range from 0.5 to 3.0 degrees, while the inclination $\beta$ should preferably be in the range from 5.0 to 9.0 degrees.

Figure 10:
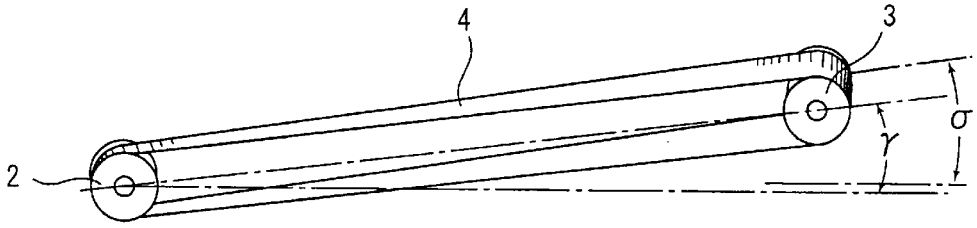
FIG. 10 is an explanatory view showing the arrangement of the lower roll and upper roll in the roll sorting machine according to the present invention viewed from the side thereof.

Also as shown in FIG. 10, the upper roll 3 should be located diagonally above the lower roll 2 at a prespecified angle of $\gamma$. As for the angle between a central axis of the upper roll 3 and a central shaft of the lower roll 2, the angle $\gamma$ between lower edges of the respective central shafts should preferably be in the range from 3.0 to 6.0 degrees, and the angle $\delta$ between the upper edges thereof should preferably be in the range from 5.0 to 9.0 degrees.

Therefore, as the inclination a is smaller than the inclination angle $\beta$, the endless belt 4 is hung over the lower roll 2 and upper roll 3 in the diagonally upward twisted state.

It is needless to say that, when the inclination angles $\alpha$ and $\beta$ and the inclination angles $\gamma$ and $\delta$ are larger or smaller than the respective specified angles, sorting can not be performed in good conditions, but as the inclination angles should change according to a feedstock to be sorted, each of the inclination angles should be decided according to types of feedstocks to be sorted.

The upper roll 3 is a drive roll with a direct connection type of speed-variable driving force source 20 directly connected to one edge thereof. The driving speed for the endless belt is adjusted to an optimum value according to a form of a feedstock to be sorted so that the feedstock rotates and drops most efficiently with the direct connection type of speed-variable driving force source 20.

In the case of a feedstock having an oval form such as soybeans, as the feedstock hardly start rotation, the driving speed should be raised to a sufficient speed before the feedstock starts rotation. In the case of a feedstock having a spheric form such as a pearl, as the feedstock easily starts rotation at a low speed, so that the driving speed should be set to a low value.

Check of the rotating state of a feedstock may visually be performed, and when monitoring is performed in a monitor camera 30 in a remote mode, the work load is reduced, which results in reduction of labor cost. Namely whether the feedstock fed onto a top surface of the endless belt is rotating appropriately is monitored with the monitor camera 30 in the remote mode, and a driving speed for the endless belt is adjusted to an optimum value according to a form of the feedstock to be sorted by adjusting the direct connection type of speed-variable driving force source 20. Similarly, the inclination angles $\alpha$, $\beta$ of the upper roll 3 and lower roll 2 and the angles $\gamma$, $\delta$ between the central shaft of the upper roll 3 and that of the lower roll 2 should be adjusted to the optimum values respectively according to a form of a feedstock to be sorted.

When the upper roll 3 is driven, the endless belt 4 rotate in the direction indicated by arrow X, and a top surface thereof is moved in the direction to the upper roll 3.

The reference numeral 6 indicates a bean receiving bar provided on a top surface of the endless belt 4, and is provided so that it forms a substantially L-shaped form at a belt edge section of the endless belt in the not-inclining side (the left-hand edge section in FIG. 8) and a belt surface in the lower roll side 2.

The reference 7 indicates a table provided under an upper surface of the endless belt 4 for preventing the endless belt 4 from becoming loose, and an inclined discharge plate 7*a* inclining downwardly and functioning as a outlet for discharging sorted soybeans are provided in the side edge section of the endless belt 4 in the downwardly inclining side thereof.

The reference numerals 8*a*, 8*b*, and 8*c* indicate saw-toothed plates each having a saw-toothed form in the lower side and arranged at an appropriate space therebetween in the horizontal direction on a top surface of the endless belt 4. There is no specific restriction over a material for the saw-toothed plates 8*a*, 8*b*, and 8*c*, but rubber should preferably be used. The saw-toothed plates 8*a*, 8*b*, 8*c* break for sorting a pile of soybeans as a feedstock fed onto a top surface of the endless belt 4 from the feedstock soybean inlet A so that the sorting operation performed on a top surface of the endless belt 4 can efficiently be performed.

Supply of feedstock soybeans is performed by a constant rate supply unit 22 to a supply point $P_1$ surrounded by the bean receiving bar 6 and the saw-toothed plate 8*a* on a top surface of the endless belt 4. Any type of constant rate supply unit may be used for the constant rate supply unit 22 so long as it has a constant rate supply mechanism for supplying a feedstock at a constant rate, and a supply rate of a feedstock should be adjusted so that the feedstock will not overflow from nor cause clogging at the supply point $P_1$. The constant rate supply unit 22 may be one having a vibration mechanism, and in this case, the fed feedstock is scattered due to vibration and does not form a pile at the feedstock soybean inlet A, so that, of the saw-toothed plates 8*a*, 8*b*, and 8*c*, the saw-toothed plate 8*a* may be omitted.

The reference numerals 9*a* and 9*b* each indicate a take-up provided at both edge sections of the lower roll 2 for adjusting tension of the endless belt 4.

The reference numeral 10*a* indicates a bean leakage prevention roll and is provided diagonally under the upper roll 3 at a position close thereto, namely so that it contacts an upper side section of the right side endless belt 4 in FIG. 8, and functions to prevent leakage of beans to be sorted. On the other hand, the reference numeral 10*b* is a snaking prevention roll, and is provided diagonally above the lower roll 2 at a position close thereto, namely so that it contacts a lower side edge section of the left side endless belt 4 in FIG. 8, and functions to prevent the belt from snaking.

The reference numerals 11*a*, 11*b* indicates guide plates for adjusting flow of soybeans provided at both edge sections of the inclined discharge section 7*a* of the table 7.

The reference numeral 13 is a sorted product outlet provided outside the inclined discharge plate, which is separated by a partition section 16 to an outlet 13*a* for acceptable products (soybeans and red beans having the regular forms, or spherical materials such as pearls) and an outlet 13*b* for secondary products including rotatable defective products (such as cracked beans having forms similar to but different from a spherical form, worm-eaten beans).

With the configuration described above, now the effects are described below. At first, when the upper roll 3 is driven, a top surface of the endless belt 4 moves toward the upper roll 3. When feedstock soybeans including foreign materials such as stone pieces, stems, and worm-eaten beans or defective products are fed from the feedstock inlet A to the supply point $P_1$ on a top surface of the endless belt 4, the feedstock soybeans move in the direction to the upper roll 3 in association with movement of the endless belt 4 and at the same time soybeans having the regular form immediately start rotating and dropping diagonally under the belt 4 and are discharged from the acceptable product outlet 13*a* via the inclined discharge section 7*a* and are accommodated in a bean receiving vessel not shown in the figure.

The soybeans piled up at the supply point $P_1$ contact and collide with the first saw-toothed plate 8*a* with the pile of soybeans broken and sorted. Soybeans having the regular form falling down from the broken pile similarly start rotation and are discharged from the acceptable product outlet 13*a* into a bean receiving vessel (not shown). Then, when the soybeans reach the supply point $P_2$, the soybeans having the regular form rotate and move diagonally downward under the endless belt 4, namely in the direction to a right edge section of the belt 4 in FIG. 1, pass through the inclined discharge section 7*a* of the table 7, and are discharged from the acceptable product outlet 13*a* or the second outlet 13*b* and are accommodated in the respective bean receiving vessels.

In this step, foreign materials other than the soybeans having the regular form such as flat or angular stone pieces, mud blocks, and stems which can not rotate smoothly move without rotating in the direction to the upper roll 3 in association with movement of the belt 4. Then at the point $P_3$, the soybeans pass over the second saw-toothed plate 8*b* to be separated further each other, and the soybeans having been released from the piled-up state rotate and move downward, and are discharged from the acceptable product outlet 13*a* or the second outlet 13*b* and are accommodated in the respective bean receiving vessels.

Foreign materials not rotatable do not move themselves nor drop, and move in association with movement of the endless belt 4. At the points $P_1$, $P_2$, and $P_3$, most of the soybeans having the regular form rotate and drop and are discharged from the acceptable outlet 13*a* or from the second outlet 13*b*. A very small quantity of soybeans having the regular beans not having rotated, for instance, because they lodge on foreign materials or the like also start rotating when they contact the third saw-toothed plate 8*c* and are sorted thereby, and are discharged from the second outlet 13*b*.

Of the foreign materials other than the soybeans having the regular form, those such as angular materials and stems, which do not rotate at all, move in association with movement of the belt 4 and reach the point $P_4$, where the foreign materials are discharged from a foreign material outlet C and drop into a foreign material receiving vessel (not shown). On the other hand, defective products such as flat form materials, cracked beans, and worm-eaten beans which rotate slightly reach the point $P_3$ or point $P_4$ according to a degree of their rotation. All of the rotatable but defective products having reached the point $P_4$ rotate downward and are discharged from the second outlet 13*b*. Most of the rotatable but defective products having reached the point $P_3$ are discharged from the second outlet 13*b*.

A twist angle of a top surface of the endless belt 4 becomes abruptly large as it goes higher, so that a rotating state of beans varies from place to place on a top surface of the endless belt 4, and this fine change in a twist angle of this endless belt 4 makes it possible to accurately differentiate normal beans (acceptable products) from defective beans (non-rotatable defective products). Further as compared to a case where a top surface of the endless belt 4 is not twisted but is simply flat, the distance required for sorting may be shorter, which enables compact structure.

The feedstock soybeans fed to the supply point $P_1$ are never moved nor scattered by the bean receiving bar 6 in the direction to the lower roll 2 or upward along inclination of the belt 4. Further when central portions of the saw-toothed plates 8*a*, 8*b*, and 8*c* are flexible as shown in FIG. 8, a clearance from a surface of the belt 4 can freely be adjusted, so that treating and sorting the feedstock soybeans piled up can freely be adjusted according to the feeding situation of the feedstock soybeans. A number of the saw-toothed plates

8*a*, 8*b*, and 8*c* is not limited to that in the embodiment described above, and any desired number of the saw-toothed plates may be installed.

It is preferable to use rubber-coated cloth for the endless belt 4, and by making smooth a surface of the belt, it becomes easier to catch foreign materials and defective grains. On the contrary, when the conventional canvas cloth for the belt, it is not easy to catch foreign materials, and further it is disadvantageously impossible to prevent snaking of the canvas cloth.

As described above, in the roll sorting machine according to the present invention, clogging at the feedstock cereal grain inlet or lowering of the sorting precision never occurs even when cereal grains more than the normal processing capacity of the machine are supplied. Further, the machine never contaminates the feedstock cereal grains, can ensure safety for workers, and can prevent the sorting precision from varying due to a difference of forms of cereal grains.

Although description of the embodiment above assumed a case where angles of the upper roll 3 and lower roll 2 are set so that the entire roll sorting machine is kept in the horizontal posture, the entire roll sorting machine 1 can be installed at a specified angle by using a raising means such as a jack machine.

Figure 11:
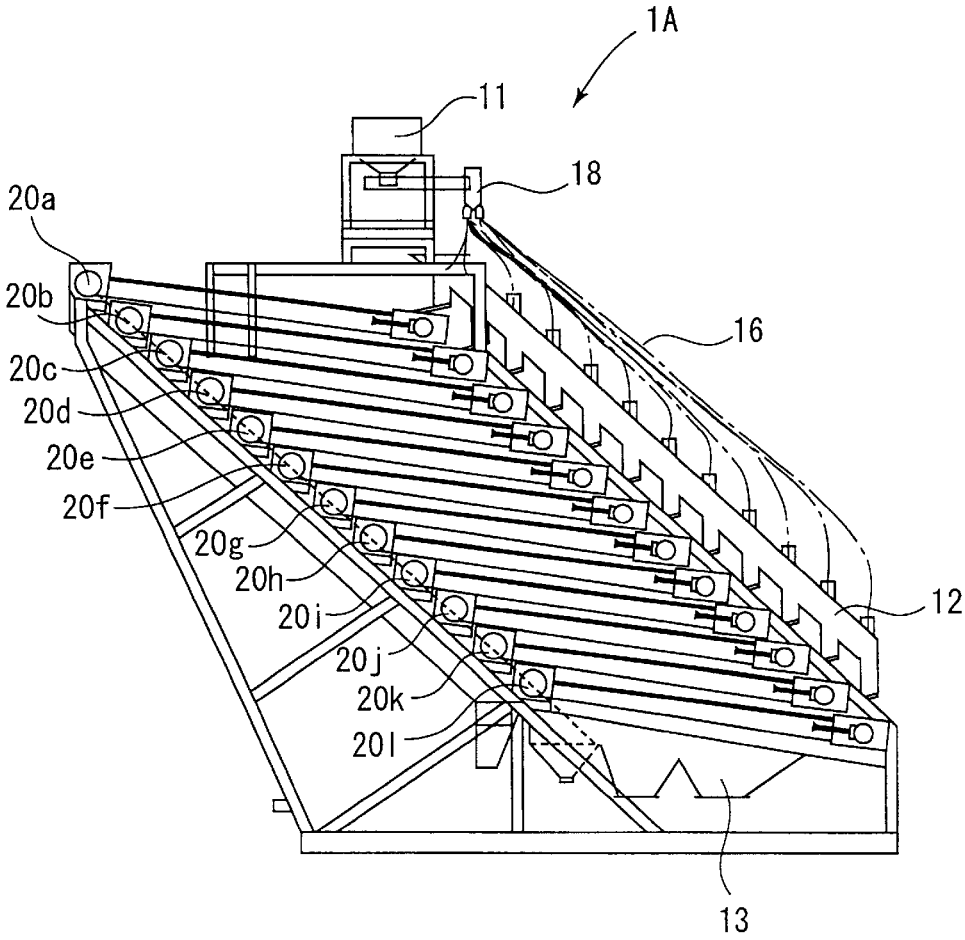
FIG. 11 is a side view showing one embodiment of a multiple stage roll sorting machine according to the present invention.
Figure 12:
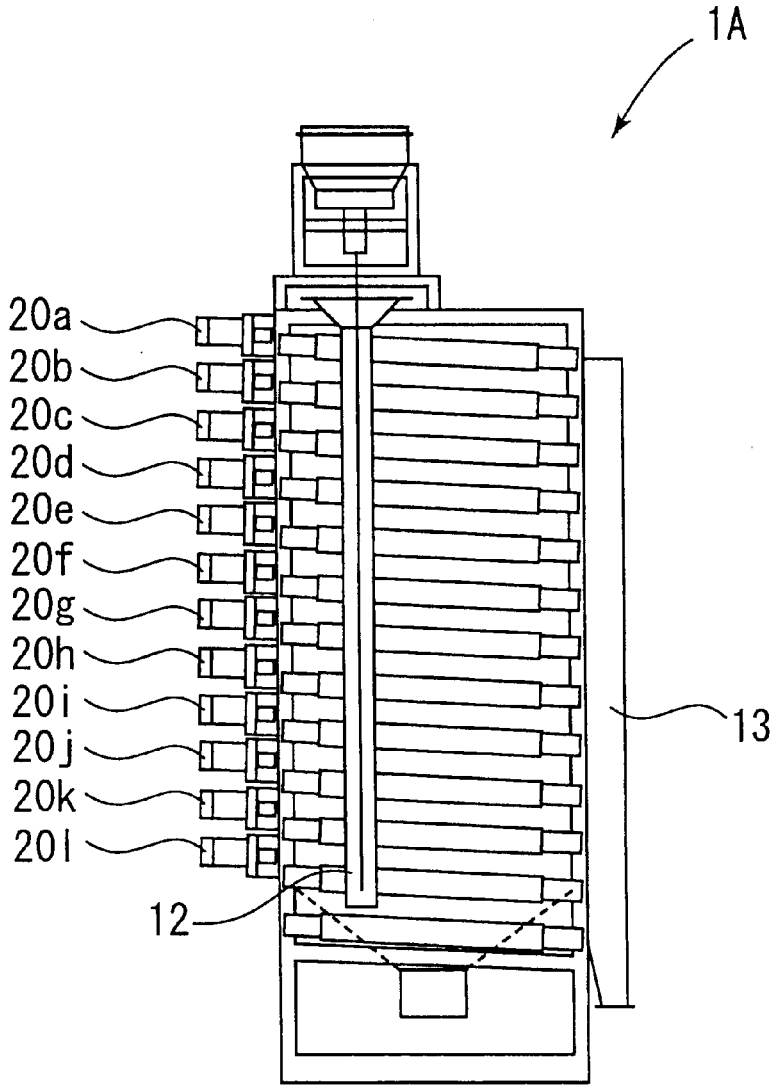
FIG. 12 is a front view showing one embodiment of the multiple stage roll sorting machine according to the present invention.

Further description of the embodiment above assumed a case where only one unit of roll sorting machine 1 is provided, but for actually sorting a vast quantity of feedstock soybeans, it is necessary to provide a multiple unit of roll sorting machines 1 for insuring a higher throughput. The examples are shown in FIG. 11 and FIG. 12. FIG. 11 is a side view showing a multi-stage type of roll sorting machine 1A, while FIG. 12 is a front view showing the multi-stage type of roll sorting machine 1A. In the examples, 12 units of roll sorting machines 1 are laid on each other in the vertical direction. In the figure, designated at the reference numeral 11 is a feedstock hopper, at 12 a feedstock soybean chute, and at 13 a sorted material outlet.

In the figure, the reference numerals 20*a* to 20*l* indicates direct connection type of speed-variable driving force sources each directly connected to an edge of an upper roll in each stage, and with the direct connection type of speed-variable driving force sources, a speed of the endless belt in each stage can be adjusted independently. With this configuration, a rotating speed of the endless belt in each stage can freely be adjusted to an optimum value according to a form of feedstock supplied thereto, which in turn makes it possible to treat various types of feedstocks more flexibly. Further as a chain is not required, the troubles and contamination caused by a chain as described above can be eliminated.

Further in this figure, designated at the reference numeral 18 is a vibration type of constant rate supply unit, and at 16 a urethane rubber pipe. In the case of multiple stage system, it is possible to supply feedstock with one vibration type of constant rate supply unit through the pipe 16 at a constant rate.

Figure 13:
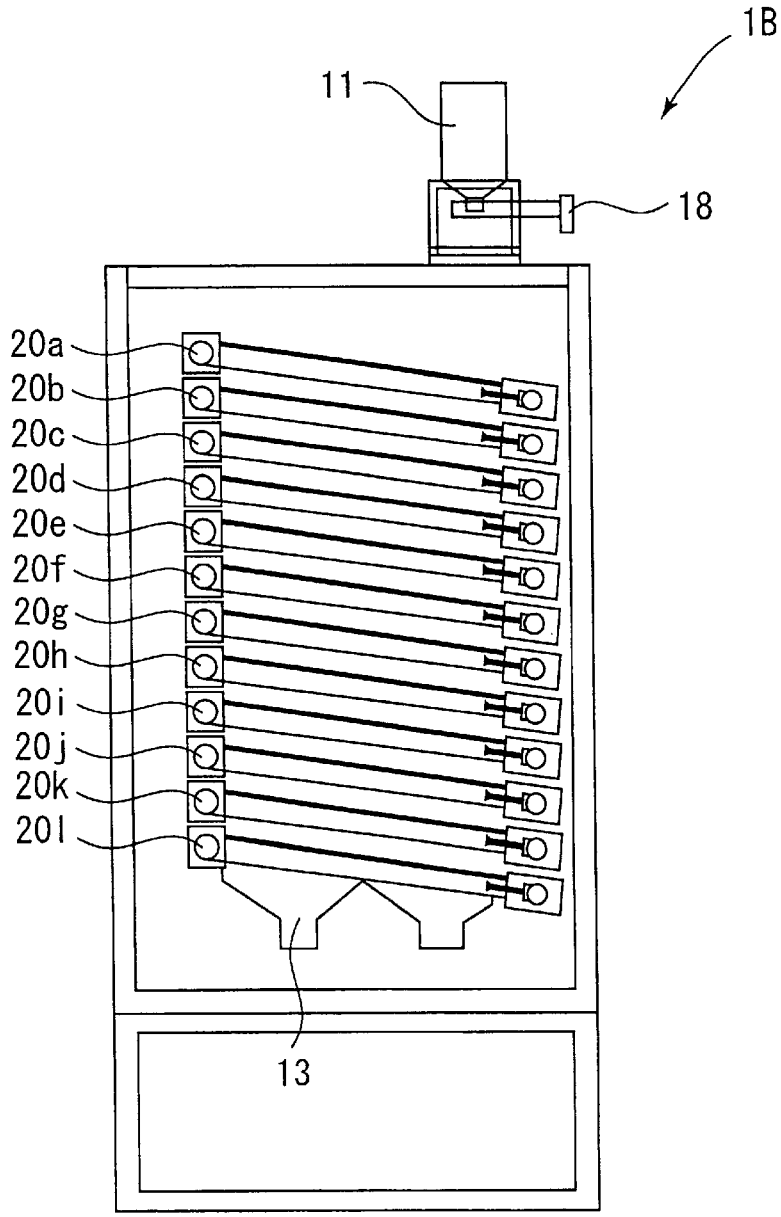
FIG. 13 is a general side view showing a case where the multiple stage roll sorting machine according to the present invention is of an erected type.

In the multiple stage roll sorting machine described above, the roll sorting machine 1 on each stage is diagonally displaced from the adjoining lower one, but an elected posture type of multiple stage sorting machine in which all of the roll sorting machines may be stacked in the vertical direction is allowable, and in this case, an area required for installation may be small, which is advantageous for space saving. For instance, in the case of the 12-stage inclined type of roll sorting machine, the area required for installation thereof is about 1.8 m (width)×5 m (length)×4.5 m (height), but in the case of the 12-stage erected type of roll sorting machine, the area required for installation thereof is only about 1.8 m(width)×2.7 m (length)×4.5 m (height), and as the area required for installation of the 12-stage erected type of roll sorting machine is only about a half of that for the 12-stage inclined type of roll sorting machine, which allows effective use of even a narrow area for installation. The example is shown in FIG. 13.

In this figure, designated at the reference numeral 11 is a feedstock hopper, at 13 a sorted material outlet, at 18 a vibration type of constant rate supply unit, at 20*a* to 20*l* each a direct connection type of speed-variable driving force source.

Description of the embodiment of the roll sorting machine according to the present invention above assumed a case of sorting soybeans, but the present invention is not limited to this embodiment. The roll sorting machine according to the present invention can sort not only spherical materials such as red beans and pearls, but also any materials which can rotate and have a form similar to a sphere, and therefore the roll sorting machine according to the present invention can widely be used for sorting cereal grains.

Capability of Exploitation in Industry

As described above, with the present invention, it has become possible to provide a cereal grain sorting system which eliminates the necessity of a specific gravity sorting machine requiring supply of a vast quantity of air and insures quiet, stable and long-term operations without deteriorating the labor environment and with high sorting precision as well as high production yield, and also which makes it possible to obtain high quality final products.

Further it has become possible to provide a roll sorting machine in which clogging at the feedstock cereal grain inlet or lowering of the sorting precision never occurs even when cereal grains more than the normal processing capacity of the machine are supplied. It also has become possible to provide the machine which never contaminates the feedstock cereal, to ensure safety for workers, and to prevent the sorting precision from varying due to a difference of forms of cereal grains.

What is claimed is:

1. A cereal grain sorting system comprising: a wind force sorting device operative for selectively sorting light weight foreign materials from feedstock cereal grains; a rough sorting device operative for selectively removing foreign materials having different diameters from the standard one from the feedstock cereal grains; and a roll sorting device operative for selectively removing foreign materials having different forms from the standard ones from the feedstock cereal grains having been subjected to said wind force sorting step as well as to said rough sorting step, the roll sorting device including at least one endless belt unit having an endless belt wrapped about an upper roll and a lower roll disposed apart from and below the upper roll as viewed in elevation such that an upper surface of the endless belt inclines upwardly from the lower roll to the upper roll as viewed in a belt moving direction and inclines transversely relative to the belt moving direction and downwardly from a feedstock supply side of the endless belt to a feedstock discharge side of the endless belt wherein the upper roll inclines downwardly relative to the feedstock supply side at a first downwardly inclination angle and the lower roll inclines downwardly relative to the feedstock supply side at a second downwardly inclination angle thereby resulting in a twisted endless belt surface twisting from the lower roll at the feedstock supply side to the upper roll toward the feedstock discharge side while the upper surface of the endless belt inclines upwardly and moves from the lower roll to the upper roll.

2. The cereal grain sorting system according to claim 1 further comprising: a magnetic force sorting device operative for selectively removing magnetic foreign materials from the feedstock cereal grains.

3. The cereal grain sorting system according to claim 1 further comprising: a stone piece removal device operative for selectively removing stone pieces from the feedstock cereal grains.

4. The cereal grain sorting system according to claim 1 further comprising: a polishing device operative for polishing off and removing fine deposits from the feedstock cereal grains.

5. The cereal grain sorting system according to claim 1 further comprising: a grain diameter sorting device operative for selectively removing feedstock cereal grains according to the grain diameters.

6. A cereal grain sorting system comprising: wind force sorting means for selectively sorting light weight foreign materials from feedstock cereal grains; rough sorting means for selectively removing foreign materials having different diameters from the standard one from the feedstock cereal grains; and roll sorting means for selectively removing foreign materials having different forms from the standard ones from the feedstock cereal grains having been subjected to said wind force sorting means as well as to said rough sorting means, the roll sorting means including at least one endless belt unit having an endless belt wrapped about an upper roll and a lower roll disposed apart from and below the upper roll as viewed in elevation such that an upper surface of the endless belt inclines upwardly from the lower roll to the upper roll as viewed in a belt moving direction and inclines transversely relative to the belt moving direction and downwardly from a feedstock supply side of the endless belt to a feedstock discharge side of the endless belt wherein the upper roll inclines downwardly relative to the feedstock supply side at a first downwardly inclination angle and the lower roll inclines downwardly relative to the feedstock supply side at a second downwardly inclination angle thereby resulting in a twisted endless belt surface twisting from the lower roll at the feedstock supply side to the upper roll toward the feedstock discharge side while the upper surface of the endless belt inclines upwardly and moves from the lower roll to the upper roll.

7. The cereal grain sorting system according to claim 6 further comprising: magnetic force sorting means for selectively removing magnetic foreign materials from the feedstock cereal grains.

8. The cereal grain sorting system according to claim 6 further comprising: stone piece removal means for selectively removing stone pieces from the feedstock cereal grains.

9. The cereal grain sorting system according to claim 6 further comprising: polishing means for polishing off and removing fine deposits from the feedstock cereal grains.

10. The cereal grain sorting system according to claim 6 further comprising: grain diameter sorting means for selectively removing feedstock cereal grains according to the grain diameters.

* * * * *